US010177437B2

(12) United States Patent
Plunkett et al.

(10) Patent No.: US 10,177,437 B2
(45) Date of Patent: Jan. 8, 2019

(54) COVER FOR ANTENNA

(71) Applicant: Lenovo (Singapore) Pte. Ltd., Singapore (SG)

(72) Inventors: Joseph David Plunkett, Raleigh, NC (US); Joseph Anthony Holung, Wake Forest, NC (US); Philip John Jakes, Durham, NC (US); Tin-Lup Wong, Chapel Hill, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 197 days.

(21) Appl. No.: 14/568,226

(22) Filed: Dec. 12, 2014

(65) Prior Publication Data

US 2016/0172744 A1 Jun. 16, 2016

(51) Int. Cl.

| | |
|---|---|
| ***H01Q 1/24*** | (2006.01) |
| ***H01Q 1/22*** | (2006.01) |
| ***H01Q 1/42*** | (2006.01) |

(52) U.S. Cl.

CPC ..... *H01Q 1/2266* (2013.01); *H01Q 1/243* (2013.01); *H01Q 1/42* (2013.01)

(58) Field of Classification Search

CPC ..... H01Q 1/24; H01Q 1/2266; H01Q 1/243; H01Q 1/42

USPC ..... 343/872, 702; 427/294

See application file for complete search history.

(56) References Cited

U.S. PATENT DOCUMENTS

| | | | | |
|---|---|---|---|---|
| 2009/0130995 | A1 | 5/2009 | Wang Chen | |
| 2010/0316229 | A1 | 12/2010 | Bibl et al. | |
| 2011/0128190 | A1* | 6/2011 | Galeev | H01Q 1/243 343/702 |
| 2013/0082885 | A1 | 4/2013 | Chiang | |
| 2013/0190052 | A1* | 7/2013 | Lundell | H04M 1/0262 455/566 |
| 2014/0113077 | A1* | 4/2014 | Tseng | D06M 11/83 427/294 |
| 2014/0375511 | A1 | 12/2014 | Song et al. | |
| 2015/0289425 | A1 | 10/2015 | Yoshida et al. | |

FOREIGN PATENT DOCUMENTS

| | | | |
|---|---|---|---|
| CN | 102804811 | A | 11/2012 |
| CN | 103037642 | A | 4/2013 |
| CN | 103891042 | A | 6/2014 |
| WO | 2013058749 | A1 | 4/2013 |
| WO | 2014065261 | A1 | 5/2014 |

* cited by examiner

*Primary Examiner* — Dieu H Duong

(74) *Attorney, Agent, or Firm* — Ference & Associates LLC

(57) ABSTRACT

One embodiment provides a device, including: an antenna; a main memory storing code; a processor operatively coupled to the antenna and which executes the code stored in the main memory, wherein the code stored in the main memory includes code which is executed to communicate via the antenna; and a device cover that includes a material having a pattern of conductive fibers and non-conductive fibers; the material including an antenna area; wherein the pattern in the antenna area includes more non-conductive fibers than conductive fibers. Other aspects are described and claimed.

19 Claims, 5 Drawing Sheets

COVER FOR ANTENNA

BACKGROUND

A communication device or mobile computer such as a laptop personal computer (PC), a tablet computing device, a smart phone, etc., has included therewith a radio communication antenna. Much the same is found with other devices used for communications, e.g., radio or wireless communication devices included in vehicles, aircraft and the like.

A radio communication antenna is located for example in a clam shell style laptop PC on an upper surface or a side surface of a liquid crystal display so that the antenna exhibits the optimum sensitivity when users use the laptop PC. In order to cope with recent demands such as broad and multiple frequency bands, a high data transfer rate, or a diversity communication, the number or size of antennas mounted on a display-side casing of the laptop PC has been increased. Again, much the same has happened with other device formats (e.g., tablets, smart phones, vehicle communication devices, aircraft communication systems, etc.).

In communication device covers, strength and conductivity are conventionally thought of as competing with one another. That is, a material such as metal is strong and thus desirable to use in a device cover enclosing or supporting an antenna. However, metal interferes with the antenna's communication capability, thus counseling use of a non-conductive material such as a resin or other non-interfering material.

Conventionally such materials (i.e., strong/rigid versus non-conductive) are applied in areas with care. For example, in a metallic display casing, cutout portions for securing the antenna sensitivity are provided in the metal structure, even though they introduce weak points in terms of strength.

BRIEF SUMMARY

In summary, one aspect provides a device, comprising: an antenna; a main memory storing code; a processor operatively coupled to the antenna and which executes the code stored in the main memory, wherein the code stored in the main memory comprises code which is executed to communicate via the antenna; and a device cover that includes a material having a pattern of conductive fibers and non-conductive fibers; the material including an antenna area; wherein the pattern in the antenna area includes more non-conductive fibers than conductive fibers.

Another aspect provides a device, comprising: an antenna; a processor operatively coupled to the antenna; and a device cover that includes a material having a pattern of conductive fibers and non-conductive fibers; the material including an antenna area; wherein the pattern in the antenna area includes more non-conductive fibers than conductive fibers.

A further aspect provides a device cover, comprising: a material having a pattern of conductive fibers and non-conductive fibers; the material including an antenna area; wherein the pattern in the antenna area includes more non-conductive fibers than conductive fibers.

A still further aspect provides a method, comprising: setting at least one antenna area of a cover; setting a pattern for fibers of the cover, wherein the pattern in at least one antenna area includes more non-conductive fibers than conductive fibers; and producing the cover using material incorporating the non-conductive fibers and the conductive fibers according to the pattern.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
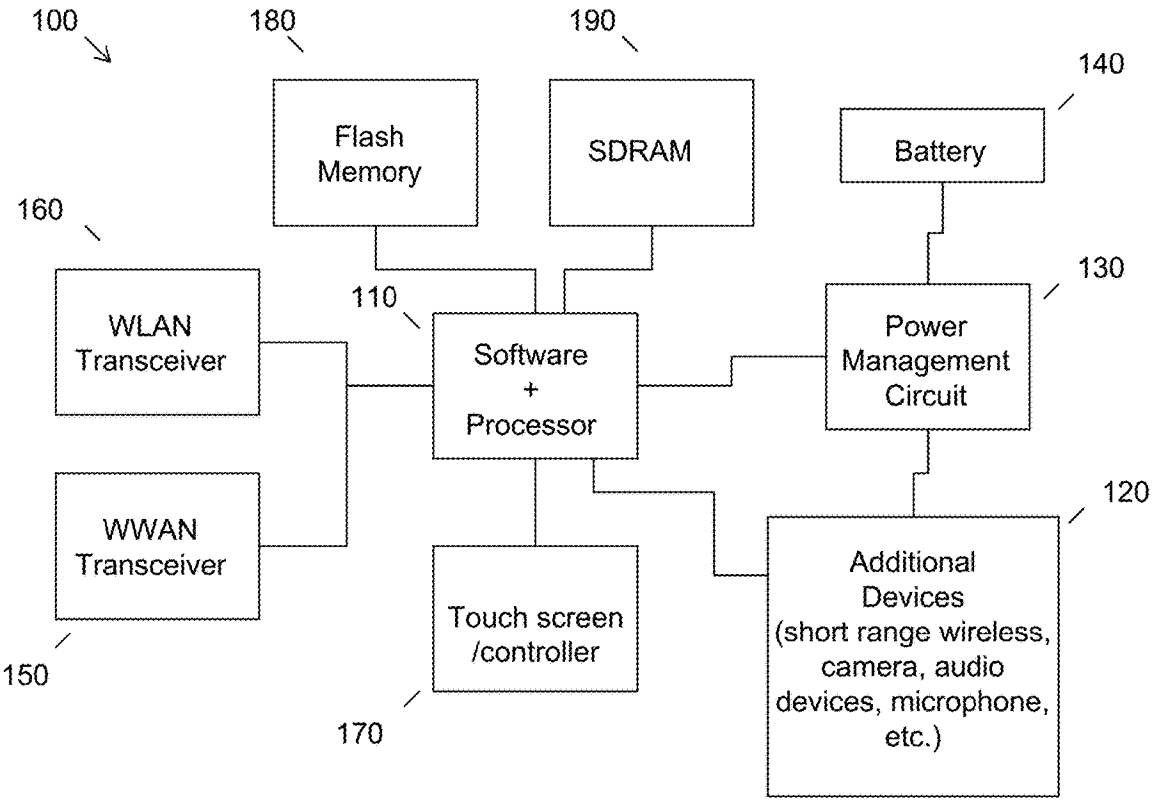
FIG. 1 illustrates an example of information handling device circuitry.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

Conventional approaches to antenna covers include an approach that attempts to form separate areas, i.e., strong conducting/interfering material areas and weaker, non-conductive/non-interfering areas, such that the overall cover is strong but exhibits acceptable interference levels and thus communication capabilities. This process has lead to many different designs in which areas (interfering and non-interfering) are joined together, e.g., in a corrugated fashion.

For example, a conventional approach to design fabrication may be as follows. A carbon fiber area is formed (which is opaque to or interferes with radio frequency (RF) communications) with a cut away of the carbon area. Replacement material (e.g., glass fiber, etc.) is cut to fit into this cut away zone (in order to reduce the interference with RF communications). The replacement material is then inserted into the cutouts. This is followed by finish processing that among other things addresses cosmetic concerns given the introduction of joints and/or seams to the cover at the material area interfaces. This process thus requires formation of and handling of additional components as well as finish processing to conceal the cosmetic artifacts of the differential materials (e.g., joints/seams are subjected to finishing to ensure cosmetic/aesthetic appearance quality).

Rather than requiring a modification of the cover to include multiple subparts and subsequent finishing operations (and associated increase in cost), an embodiment provides a custom weave pattern of conductive fibers (e.g., carbon fibers or other interfering type fiber of choice necessary for strength) with a limited ratio of alternative non-conductive/non-interfering fibers, such as glass fiber or KEVLAR fiber. KEVLAR is a registered trademark of E. I. du Pont de Nemours and Company in the United States and other countries.

An embodiment provides a weaving pattern that is a sufficiently open mesh with respect to the carbon content in specific zones to allow RF signals to permeate the cover material. While the fabric becomes a unique material for each implementation, the weaving is automated and will not suffer the manual molding cycle time impact of handling additional parts. Nor will this approach suffer the joint(s) and/or seam(s) required between two dissimilar materials, i.e., that need to be managed for cosmetic effects.

The illustrated example embodiments will be best understood by reference to the figures. The following description is intended only by way of example, and simply illustrates certain example embodiments.

While various other circuits, circuitry or components may be utilized in information handling devices, with regard to smart phone and/or tablet circuitry 100, an example illustrated in FIG. 1 includes a system on a chip design found for example in tablet or other mobile computing platforms. Software and processor(s) are combined in a single chip 110. Processors comprise internal arithmetic units, registers, cache memory, busses, I/O ports, etc., as is well known in the art. Internal busses and the like depend on different vendors, but essentially all the peripheral devices (120) may attach to a single chip 110. The circuitry 100 combines the processor, memory control, and I/O controller hub all into a single chip 110. Also, systems 100 of this type do not typically use SATA or PCI or LPC. Common interfaces, for example, include SDIO and I2C.

There are power management chip(s) 130, e.g., a battery management unit, BMU, which manage power as supplied, for example, via a rechargeable battery 140, which may be recharged by a connection to a power source (not shown). In at least one design, a single chip, such as 110, is used to supply BIOS like functionality and DRAM memory.

System 100 typically includes one or more of a WWAN transceiver 150 and a WLAN transceiver 160 and associated antennas for connecting to various networks, such as telecommunications networks and wireless Internet devices, e.g., access points. Additionally, devices 120 are commonly included, e.g., cameras, external input devices, short range wireless and/or near field communication devices, and the like. System 100 often includes a touch screen 170 for data input and display/rendering. System 100 also typically includes various memory devices, for example flash memory 180 and SDRAM 190.

Figure 2:
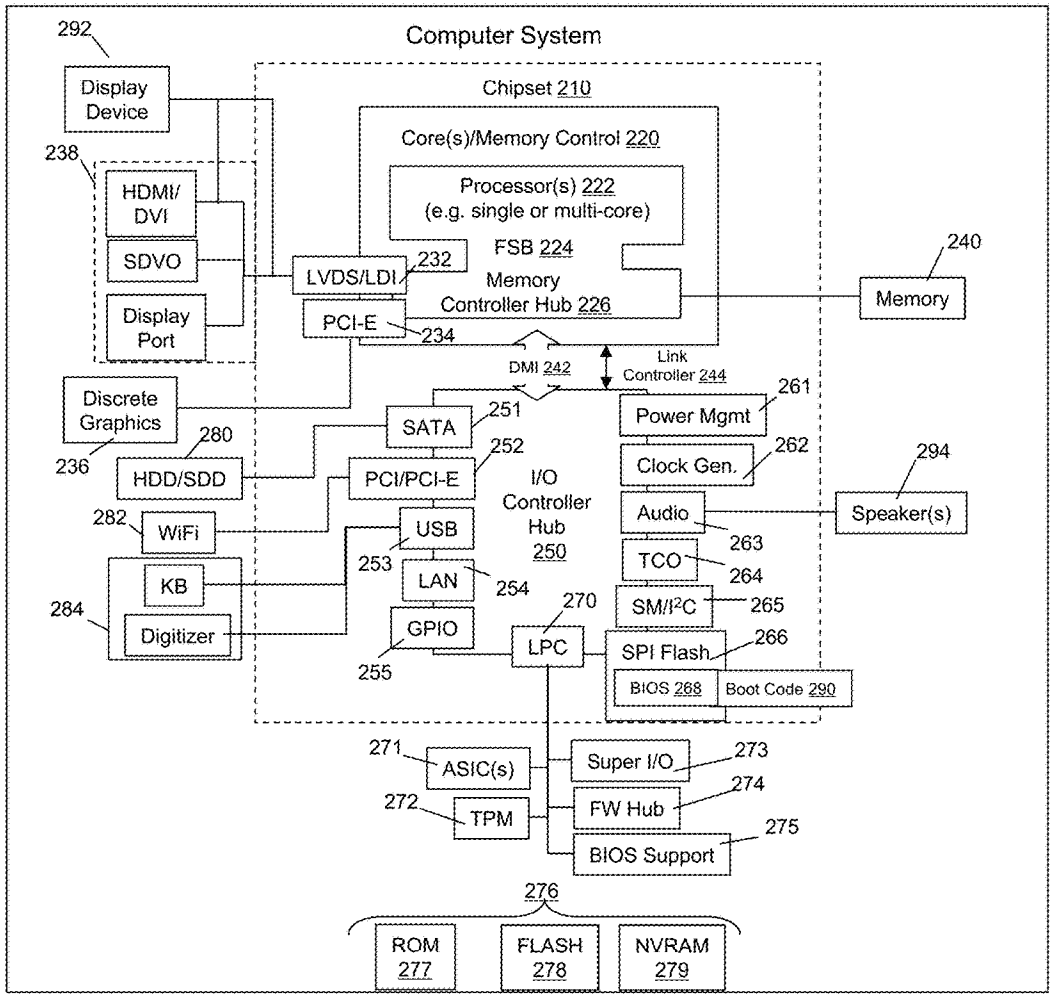
FIG. 2 illustrates another example of information handling device circuitry.

FIG. 2 depicts a block diagram of another example of information handling device circuits, circuitry or components. The example depicted in FIG. 2 may correspond to computing systems such as the THINKPAD series of personal computers sold by Lenovo (US) Inc. of Morrisville, N.C., or other devices. As is apparent from the description herein, embodiments may include other features or only some of the features of the example illustrated in FIG. 2.

The example of FIG. 2 includes a so-called chipset 210 (a group of integrated circuits, or chips, that work together, chipsets) with an architecture that may vary depending on manufacturer (for example, INTEL, AMD, ARM, etc.). INTEL is a registered trademark of Intel Corporation in the United States and other countries. AMD is a registered trademark of Advanced Micro Devices, Inc. in the United States and other countries. ARM is an unregistered trademark of ARM Holdings plc in the United States and other countries. The architecture of the chipset 210 includes a core and memory control group 220 and an I/O controller hub 250 that exchanges information (for example, data, signals, commands, etc.) via a direct management interface (DMI) 242 or a link controller 244. In FIG. 2, the DMI 242 is a chip-to-chip interface (sometimes referred to as being a link between a "northbridge" and a "southbridge"). The core and memory control group 220 include one or more processors 222 (for example, single or multi-core) and a memory controller hub 226 that exchange information via a front side bus (FSB) 224; noting that components of the group 220 may be integrated in a chip that supplants the conventional "northbridge" style architecture. One or more processors 222 comprise internal arithmetic units, registers, cache memory, busses, I/O ports, etc., as is well known in the art.

In FIG. 2, the memory controller hub 226 interfaces with memory 240 (for example, to provide support for a type of RAM that may be referred to as "system memory" or "memory"). The memory controller hub 226 further includes a low voltage differential signaling (LVDS) interface 232 for a display device 292 (for example, a CRT, a flat panel, touch screen, etc.). A block 238 includes some technologies that may be supported via the LVDS interface 232 (for example, serial digital video, HDMI/DVI, display port). The memory controller hub 226 also includes a PCI-express interface (PCI-E) 234 that may support discrete graphics 236.

In FIG. 2, the I/O hub controller 250 includes a SATA interface 251 (for example, for HDDs, SDDs, etc., 280), a PCI-E interface 252 (for example, for wireless connections 282), a USB interface 253 (for example, for devices 284 such as a digitizer, keyboard, mice, cameras, phones, microphones, storage, other connected devices, etc.), a network interface 254 (for example, LAN), a GPIO interface 255, a LPC interface 270 (for ASICs 271, a TPM 272, a super I/O 273, a firmware hub 274, BIOS support 275 as well as various types of memory 276 such as ROM 277, Flash 278, and NVRAM 279), a power management interface 261, a clock generator interface 262, an audio interface 263 (for example, for speakers 294), a TCO interface 264, a system management bus interface 265, and SPI Flash 266, which can include BIOS 268 and boot code 290. The I/O hub controller 250 may include gigabit Ethernet support.

The system, upon power on, may be configured to execute boot code 290 for the BIOS 268, as stored within the SPI Flash 266, and thereafter processes data under the control of one or more operating systems and application software (for example, stored in system memory 240). An operating system may be stored in any of a variety of locations and accessed, for example, according to instructions of the BIOS 268. As described herein, a device may include fewer or more features than shown in the system of FIG. 2.

Figure 3:
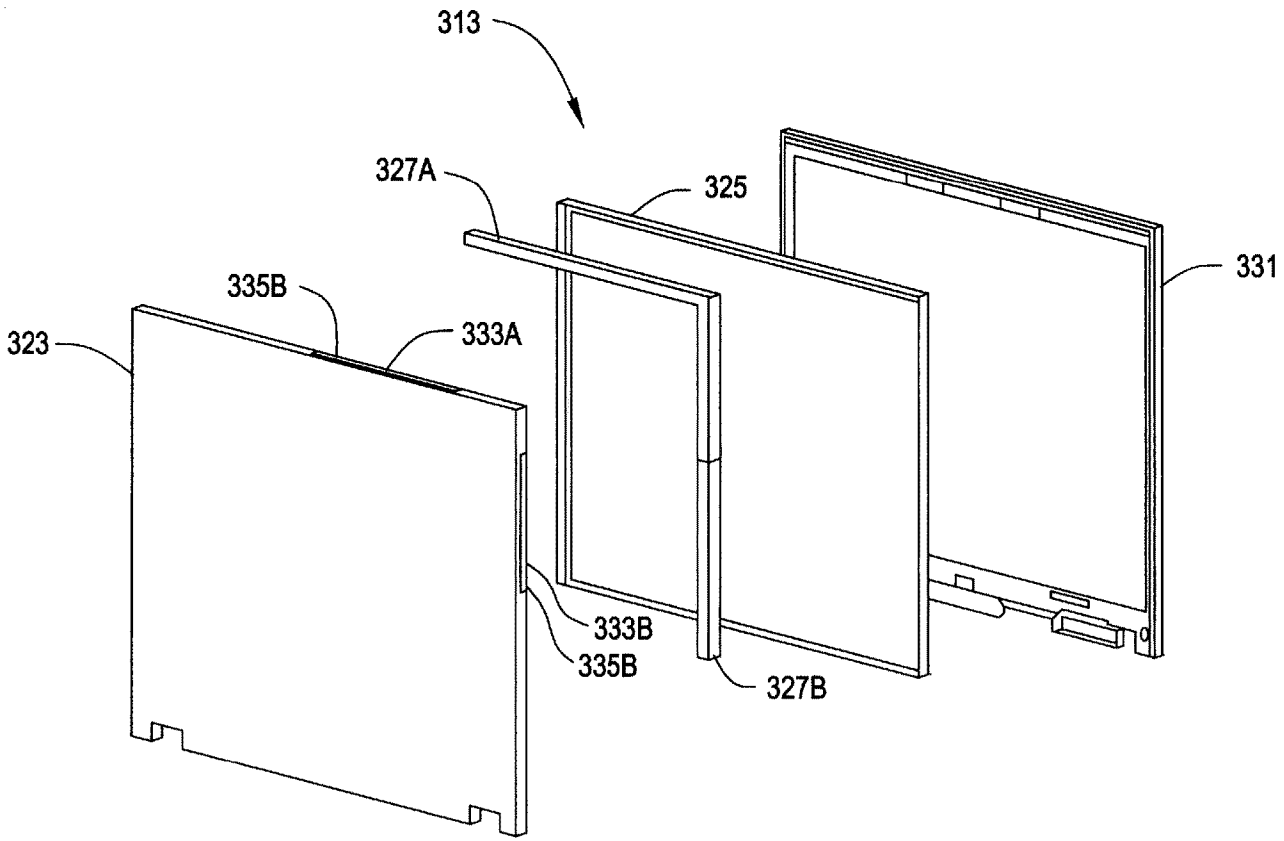
FIG. 3 illustrates an example conventional antenna cover with cut outs.

Information handling device circuitry, as for example outlined in FIG. 1 or FIG. 2, may be used in devices such as tablets, smart phones, personal computer devices generally, and/or electronic or communication devices that employ antennas to communicate wirelessly. For example, FIG. 3 is a schematic perspective view illustrating a structure of a display portion 313 of a conventional laptop PC. The display portion 313 includes a display casing 323, a display module 325, antenna mounting portions 327*a* and 327*b*, and a bezel 331. A variety of types of radio communication antennas may be mounted on the antenna mounting portions 327*a* and 327*b*. The display casing 323 has a box-like structure, and the display module 325 is fixedly accommodated therein. The antenna mounting portions 327*a* and 327*b* are disposed between a side portion of the display module 325 and an inner surface of the display casing 323. The bezel 331 is disposed on a front surface of the display module 325 to be mounted on the display casing 323.

The display casing 323 is a structure for protecting internal components of, for example, the display module 325 from an external pressing force. For this reason, the display casing 323 has usually been formed of a thick glass fiber reinforced plastic. Increasingly, in order to achieve a thin size and a light weight while maintaining strength of the casing, light metals such as aluminum alloys or magnesium alloys are often used instead of glass fiber reinforced plastic.

When antennas mounted on the antenna mounting portions 327*a* and 327*b* are disposed inside the display casing 323 formed of a conductive material such as metal, the sensitivity may be lowered. For this reason, in the case of the display casing 323 formed of metal, a structure is typically used in which cutouts 333*a* and 333*b* are formed in parts of a side portion thereof corresponding to the antennas, and caps 335*a* and 335*b* configured by nonconductive members such as rubber or plastics are packed into the cutouts 333*a* and 333*b*.

However, when the cutouts 333*a* and 333*b* are formed in the display casing 323, the strength at these portions is inevitably lowered undesirably. For this reason, it is necessary to decide the structure of the display casing 323 with the presumption that the strength will be lowered by the cutouts 333*a* and 333*b* so that sufficient strength can be ensured. Particularly, when a plurality of antennas is mounted on one casing, the cutouts are required by the number of antennas mounted, so that it leads to a limit in achieving a thin size and lightweight in a metallic casing. Much the same difficulty is faced in device coverings for circuitry such as outlined in FIG. 1, i.e., mobile computing devices such as tablets, smart phones, etc. Generally then, all communication device coverings encounter a difficulty in achieving a balance between strength and communication functionality with respect to the antenna placement.

Figure 4:
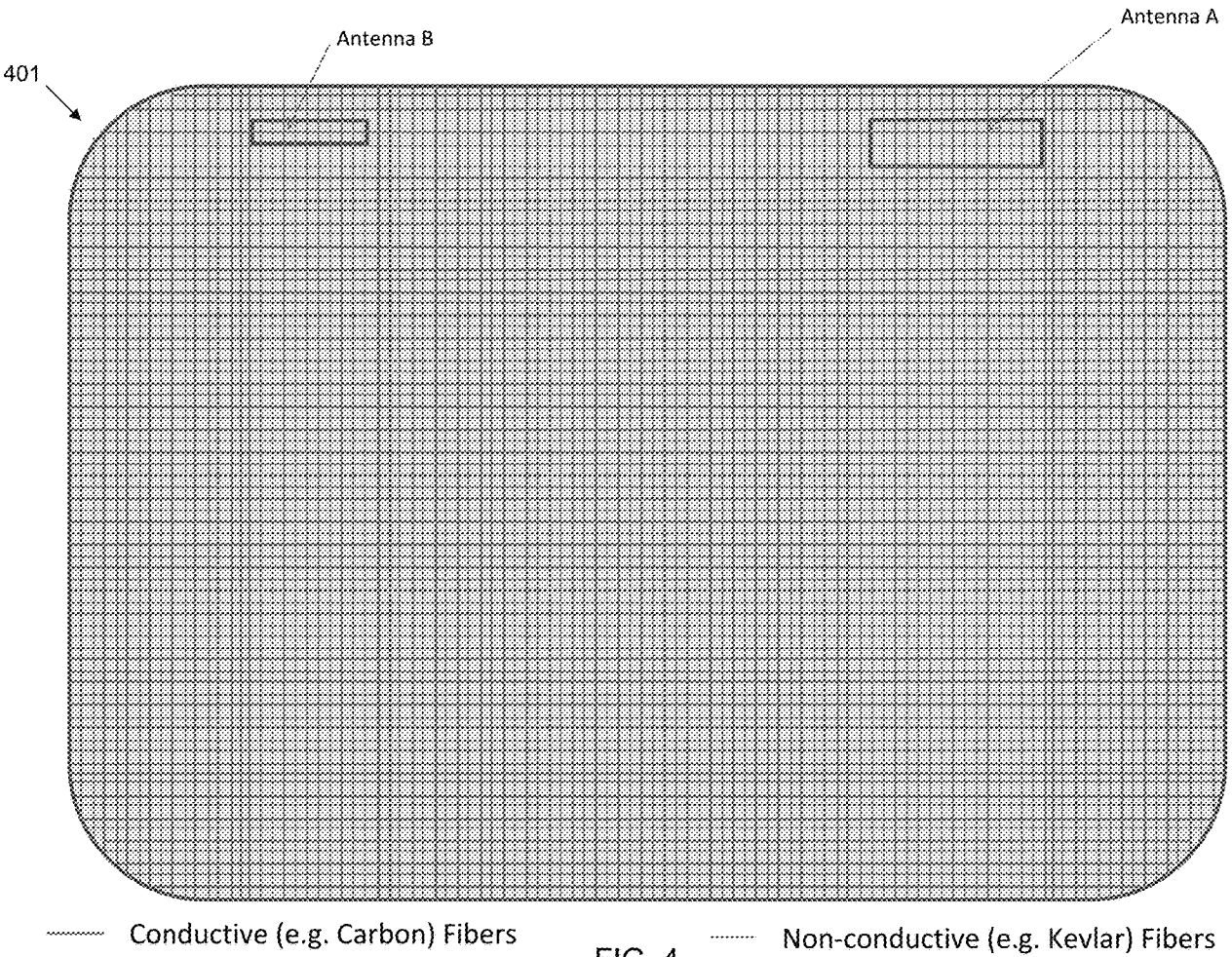
FIG. 4 illustrates an example antenna cover according to an embodiment.

Referring to FIG. 4, an embodiment provides a custom weave pattern of fibers (of varying types, as further described herein) for a device cover 401. The example illustrated in FIG. 4 is a cover suitable for use with a tablet or smart phone device; however, as is apparent from the description, covers for other devices that include antennas may be suitably designed using the teachings provided herein.

As illustrated in FIG. 4, a weave pattern includes a limited ratio of conductive fibers (e.g., carbon fibers) and non-conductive fibers (e.g., KEVLAR fibers or other non-interfering fibers, such as glass fibers). In some cases the conductive and/or non-conductive fibers may be coated, e.g., with resin, or may take the form of a hybrid material, e.g., a composite of more than one material may be used to form a fiber.

The weaving pattern is a sufficiently open mesh with respect to the conductive fiber content in specific zones, e.g., Antenna A and Antenna B areas in FIG. 4, to allow RF signals to permeate the cover material. Specifically, the weave pattern illustrated in FIG. 4 highlights that non-conductive fibers are used exclusively in the antenna areas (Antenna A and Antenna B) such that the conductive/interfering fibers are omitted or excluded from the weave pattern to avoid disruption of RF signaling, e.g., via Wi-Fi antenna located at Antenna A and Antenna B areas.

In an embodiment, the weave pattern is designed to fit the antenna layout of the particular device. In production, the cover material is woven with specific fiber inclusion/exclusion in the particular areas according to the weave pattern. While the fabric or cover material is a custom pattern unique to each implementation, the weave is automated and therefore will proceed quickly once the weave pattern has been set. Additionally, the use of a custom weave pattern does not suffer the manual molding cycle time impact of handling additional parts. Moreover, the areas having differential fiber content, e.g., Antenna A and Antenna B areas of FIG. 4, do not include joints or seams. This enhances the strength of the cover material as compared to joined material areas and eliminates the cosmetic effects of joints and seams.

As will be appreciated, depending on the type of fibers chosen for the weave pattern, some or all conductive fibers may be excluded from the antenna areas. In the illustrated example, Antenna A and Antenna B areas of the weave pattern are completely devoid of any conductive fibers. This is not a strict requirement, however, and may be modified to suit the particular fibers chosen, the type and sensitivity of the antenna, etc. For example, the conductive/non-conductive fiber ratio may vary in the antenna area depending on factors such as fiber material, antenna sensitivity, proximity to the antenna in question, surrounding materials, strength/rigidity requirements of the cover, etc.

Figure 5:
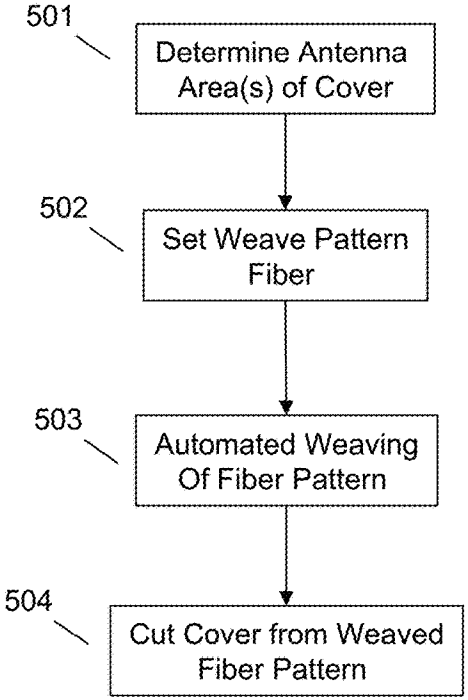
FIG. 5 illustrates an example method of producing an antenna cover according to an embodiment.

An embodiment therefore represents a shift in the production process of antenna covers, particularly for personal/mobile communication devices. Referring to FIG. 5, the area(s) that will overly or be proximate to an antenna are determined at 501. As described herein, this may be a physical area associated with the physical area occupied by an antenna, more physical area than occupied by an antenna, or less physical area than occupied by an antenna. The antenna area(s) of the cover therefore may be dictated by the fiber material, the antenna type or characteristics, the location of the cover with respect to the antenna or other components, the area of the cover (e.g., curved portion, flat portion, etc) or combinations of the foregoing.

Once antenna area(s) have been determined for the implementation, a weave pattern is set at 502. By this it is meant that the weave pattern for conductive and non-conductive fibers is set such that in the antenna area(s), non-conductive fibers predominate or are used to the exclusion of conductive, e.g., carbon, fibers. The weave pattern is then sent to direct an automated weaving process at 503 such that the chosen fibers are included in the pattern set at 502. This may include a process whereby cover material such as fabric is weaved in a pattern that repeats, i.e., individual cover pieces may be cut at 504 from the weaved pattern for use in individual device covers.

Example embodiments are described herein with reference to the figures, which illustrate example methods, devices and products according to various examples. It will be understood that the illustrated examples are non-limiting and merely presented to illustrate certain aspects that guide the understanding of the disclosure. For example, as used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A device, comprising:

an antenna;

a main memory storing code;

a processor operatively coupled to the antenna and which executes the code stored in the main memory, wherein the code stored in the main memory comprises code which is executed to communicate via the antenna; and a device cover that includes a material having a pattern of conductive fibers and non-conductive fibers;

the material including at least two antenna areas;

wherein the pattern in the at least two antenna areas includes more non-conductive fibers than conductive fibers, each of the at least two antenna areas comprising a different ratio of non-conductive fibers to conductive fibers than another of the at least two antenna areas, the ratio being based on an antenna type associated with each of the at least two antenna areas.

2. The device of claim 1, wherein the conductive fibers are carbon fibers.

3. The device of claim 1, wherein the non-conductive fibers are glass fibers.

4. The device of claim 1, wherein the material comprises a fabric woven with a weave pattern of conductive and non-conductive fibers.

5. The device of claim 1, wherein the pattern in the antenna area includes non-conductive fibers that extend from a non-antenna area to the antenna area of the cover.

6. The device of claim 1, wherein the pattern includes one or more conductive fibers that extend from one end of the cover to a substantially opposite end of the cover without traversing the antenna area.

7. The device of claim 6, wherein the pattern includes one or more non-conductive fibers that extend from one end of the cover to a substantially opposite end of the cover while traversing the antenna area.

8. The device of claim 1, wherein the antenna area comprises a plurality of antenna areas.

9. A device, comprising:

an antenna;

a processor operatively coupled to the antenna; and a device cover that includes a material having a pattern of conductive fibers and non-conductive fibers;

the material including at least two antenna areas;

wherein the pattern in the at least two antenna areas includes more non-conductive fibers than conductive fibers, each of the at least two antenna areas comprising a different ratio of non-conductive fibers to conductive fibers than another of the at least two antenna areas, the ratio being based on an antenna type associated with each of the at least two antenna areas.

10. A device cover, comprising:

a material having pattern of conductive fibers and non-conductive fibers;

the material including at least two antenna areas;

wherein the pattern in the at least two antenna areas includes more non-conductive fibers than conductive fibers, each of the at least two antenna areas comprising a different ratio of non-conductive fibers to conductive fibers than another of the at least two antenna areas, the ratio being based on an antenna type associated with each of the at least two antenna areas.

11. The device cover of claim 10, wherein the conductive fibers are carbon fibers.

12. The device cover of claim 10, wherein the non-conductive fibers are glass fibers.

13. The device cover of claim 10, wherein the material comprises a fabric woven with a weave pattern of conductive and non-conductive fibers.

14. The device cover of claim 13, wherein the fabric includes resin coated fibers.

15. The device cover of claim 10, wherein the pattern in the antenna area includes non-conductive fibers that extend from a non-antenna area to the antenna area of the cover.

16. The device cover of claim 10, wherein the pattern includes one or more conductive fibers that extend from one end of the cover to a substantially opposite end of the cover without traversing the antenna area.

17. The device cover of claim 16, wherein the pattern includes one or more non-conductive fibers that extend from one end of the cover to a substantially opposite end of the cover while traversing the antenna area.

18. The device cover of claim 10, wherein the antenna area comprises a plurality of antenna areas.

19. A method, comprising:

setting at least two antenna areas of a cover;

setting a pattern for fibers of the cover, wherein the pattern in the at least two antenna areas includes more non-conductive fibers than conductive fibers, each of the at least two antenna areas comprising a different ratio of non-conductive fibers to conductive fibers than another of the at least two antenna areas, the ratio being based on an antenna type associated with each of the at least two antenna areas; and producing the cover using material incorporating the non-conductive fibers and the conductive fibers according to the pattern.

* * * * *